United States Patent [19]

Withnall et al.

[11] Patent Number: 4,488,035

[45] Date of Patent: Dec. 11, 1984

[54] THROUGH-TICKETING IN A PASSENGER TRANSPORT SYSTEM

[75] Inventors: Malcolm D. N. Withnall; Martin J. Pemberton, both of Warwick; Kevin McManus, Warwickshire, all of England

[73] Assignee: DCA Design Consultants Limited, Warwick, England

[21] Appl. No.: 425,373

[22] Filed: Sep. 28, 1982

[30] Foreign Application Priority Data

Apr. 7, 1982 [DK] Denmark ..... 1606/82
Apr. 7, 1982 [EP] European Pat. Off. ..... 82301829.6

[51] Int. Cl.[3] ..... G07B 15/02

[52] U.S. Cl. ..... 235/384; 235/462; 340/825.33

[58] Field of Search ..... 235/384, 462; 340/825.31, 825.32, 825.33

[56] References Cited

U.S. PATENT DOCUMENTS 3,486,600 12/1969 Tanaka .
3,624,608 11/1971 Altman et al. ..... 340/825.33 X
3,748,441 7/1973 Halpern .
3,859,507 1/1975 Konya ..... 235/384
4,408,121 10/1983 Galatha ..... 235/462 X

FOREIGN PATENT DOCUMENTS 1198718 7/1970 United Kingdom .
1508988 4/1978 United Kingdom .
1510921 5/1978 United Kingdom .

*Primary Examiner*—David L. Trafton
*Attorney, Agent, or Firm*—Scrivener Clarke Scrivener and Johnson

[57] ABSTRACT

A passenger-carrying vehicle (for example a bus) in a passenger transport system is equipped with a ticket reader (18) capable of optically reading information printed on a ticket (10) in bar-code and determining whether or not the ticket is valid. A ticket-printer (16) is provided for issuing bar-coded tickets, and both the reader (18) and the printer (16) are microprocessor-based and associated with a memory (14). Fare-table data is stored in the memory (14*a*), for reference by the ticket-issuing means, data is stored in the memory (14*b*) for reference by the ticket-checking means, and both the issuing means and the checking means can communicate information to the memory (14*c*) and (14*d*) to enable data concerning tickets handled to be stored for subsequent retrieval for management purposes.

13 Claims, 3 Drawing Figures

THROUGH-TICKETING IN A PASSENGER TRANSPORT SYSTEM

It can be of substantial advantage, both to the transport operators and to the travelling public, to provide efficient through-ticketing facilities in a passenger transport system. (By "through-ticketing facilities" are meant, where the term is used herein, provisions which enable passengers to travel with a single ticket on more than one vehicle of the transport system.) The necessity for a separate ticket to be issued to a passenger for each vehicle travelled on, where through-ticketing facilities are not available, is clearly inefficient and disadvantageous in many respects.

Through-ticketing has been used for a long time on railway systems, but unautomated. Some automation has been introduced into underground railway networks, but this has largely been limited to the initial issuing of the ticket and the final validity check (and collection) on the station at journey's end; for example, it is known for magnetically-encoded tickets to be used for automatic fare collection.

Certain very limited through-ticketing facilities have been introduced on buses. For example, on many public transport systems it is possible to travel to an unlimited extent, but for a limited period, using a season ticket. However, for those who are not season ticket holders, each journey, or each portion of a through journey involving a different bus, must usually be paid for separately and a separate ticket obtained on the bus.

It is believed that the introduction of more general through-ticketing facilities could lead to much greater efficiency of operation and encourage people to travel more frequently and over greater distances on a transport system. In the absence of any suitably automated system, a major problem with through-ticketing, particularly with regard to buses, has so far appeared to be that of checking the tickets already held by boarding passengers, to prevent passengers making journeys for which their tickets are not valid. Whereas on a railway, or underground, network a passenger can be obliged to remain on railway property until journey's end, a bus passenger cannot be so restricted. Accordingly, whereas it is possible, and may be adequate, on a railway network simply to check a ticket at the beginning and end of a journey, a bus ticket should be checked on each vehicle travelled on. As a consequence, the amount of ticket checking required on a bus network is very much greater than is needed on a railway, or underground, network. Quite apart from the time which would be taken, in an unautomated system, if an inspector (who would often also be the driver of the bus) had to look at all incoming tickets to check them, the complexity of the information which the tickets would bear, if through-ticketing were to be applied at all generally on a transport system of any size, would make the task of checking for validity most daunting. A further problem, which arises at present with unautomated through-ticketing of the season ticket kind, is that of loss of management information; once a season ticket has been issued no record can be kept of its use, and it has been necessary to employ survey teams to collect data on a statistical basis.

Clearly, if through-ticketing is to be applied generally to a transport system, and especially if buses are involved, automatic ticket checking is desirable if not essential. Until now it has been believed that the wide variety of ticket kinds (single, return, season etc.), the enormous complexity of fare structures and possible journey variations, and the difficulty of operating sensitive automatic checking equipment in the arduous and harsh circumstances of, for example, a bus would make automatic ticket-checking impracticable if through-ticketing were to be applied to a transport system of any significant size.

It is an object of the present invention to enable efficient through-ticketing in a passenger transport system, tickets held by passengers being checked automatically for validity on board a vehicle.

In accordance with the invention, in one of its aspects, a passenger-carrying vehicle is equipped with ticket-checking means capable of reading information presented to it on a ticket in a printed bar-code form, capable of distinguishing between valid and invalid tickets, and capable of indicating that an invalid ticket has been presented.

By "bar-code" is meant, where the term is used herein, a code by means of which information (e.g. a sequence of digits) can be presented in an optically-machine-readable form, each of a plurality of basic elements which are available to constitute the information in code being represented by a uniquely arranged group of marks, or spaces between marks, the marks being in the general form of bars. By a "side-by-side" bar-code format, where the expression is used hereinafter, is meant a format, which we have devised, in which the bars of each basic code element are arranged on a line extending generally unidirectionally along the lengths of the bars. By an "end-to-end" bar-code format, where the expression is used hereinafter, is meant a format in which the bars of each basic code element are arranged on a line extending generally unidirectionally transversely of the lengths of the bars; in a known end-to-end format, which has been used in various different applications, the bars are in parallel with one another and of equal length.

We have found that by employing a bar-code form, for machine-readable presentation of information on a ticket, it becomes practicable to install automatic ticket-checking equipment on passenger-carrying vehicles (even on buses), and to provide for a through-ticketing system which can accommodate the complexities of a passenger transport system of substantial size.

In a preferred arrangement, the ticket-checking means is capable of assessing the validity of a ticket by reading information presented to it in a bar-code form on the ticket and comparing the read information with reference information to which it has access. Preferably the vehicle is equipped with data-storing means whereby the reference information can be stored, although by means of a radio data link it might be possible to refer to information stored elsewhere. Up-dating means, whereby the reference information can be modified as the vehicle travels, can in a bus, for example, comprise a fare-stage up-date key to be operated by the driver.

For management purposes, it is highly desirable that the ticket-checking means be capable of communicating read information to a data store for subsequent retrieval. Preferably the vehicle is equipped with suitable data-storing means whereby the information can be recorded.

Whilst through-tickets can be supplied entirely on a pre-purchase basis, that is to say prior to a passenger boarding a vehicle, at least in the case of bus travel it is usually the case that a facility for purchasing tickets on board the vehicle is desirable. Accordingly, a vehicle in accordance with the invention may be equipped also with ticket-issuing means arranged to issue tickets bearing information presented in a bar-code form readable by the ticket-checking means. It may be required that the ticket issuing means is capable of printing on to a ticket in a bar-code form information which can be read by the ticket-checking means and which indicates travel permissible with the ticket issued. Ticket stock might be pre-printed with certain information (e.g. serial numbers) in bar-code, in which case it may not be necessary for the ticket-issuing means to print further information in bar-code, but it is preferred that the ticket issuing means be arranged to print serial numbers (in bar-code) on to tickets upon issue.

Again for management purposes, it may often be desirable that the ticket-issuing means be capable of communicating to a data store, for subsequent retrieval, information born by tickets issued, and preferably the vehicle itself is equipped with suitable data-storing means whereby the information can be recorded.

For storing information to which ticket-checking means refers, and/or for recording information read by ticket-checking means and/or communicated by ticket-issuing means, any suitable data-storing means can be used. The ticket-issuing and ticket-checking means are preferably microprocessor based and the choice of data to be stored can be determined by software. In order to gain access to the stored data, the microprocessor could periodically be connected up to a computer terminal, though it might prove more convenient to connect it to a portable data-logger which would record the information (for example on magnetic tape) for future play-back to the computer.

The ticket-issuing means preferably has access, usually via a control console, to fare-table information stored, for example, in interchangeable memory chips or on magnetic tape cassettes. Provision for regularly up-dating the fare-tables is, of course, usually needed, and equipment suitable for providing these facilities is already known.

The ticket-checking means may be arranged to read tickets bearing information in an end-to-end bar-code format (as hereinbefore defined). This could enable the information to be read by a single reading head in a single sweep. However, we have found that this format tends to be wasteful of space and where, as on a bus ticket of orthodox dimensions, there can be a shortage of space available for printing all the information needed for a through-ticketing system, a side-by-side format (as hereinbefore defined) may be much preferable.

There now follows a description, to be read with reference to the accompanying drawings, of a bus equipped for through-ticketing in a passenger transport system. It is to be understood that the bus and the ticketing system have been selected for description to illustrate the invention by way of example only.

Figure 1:
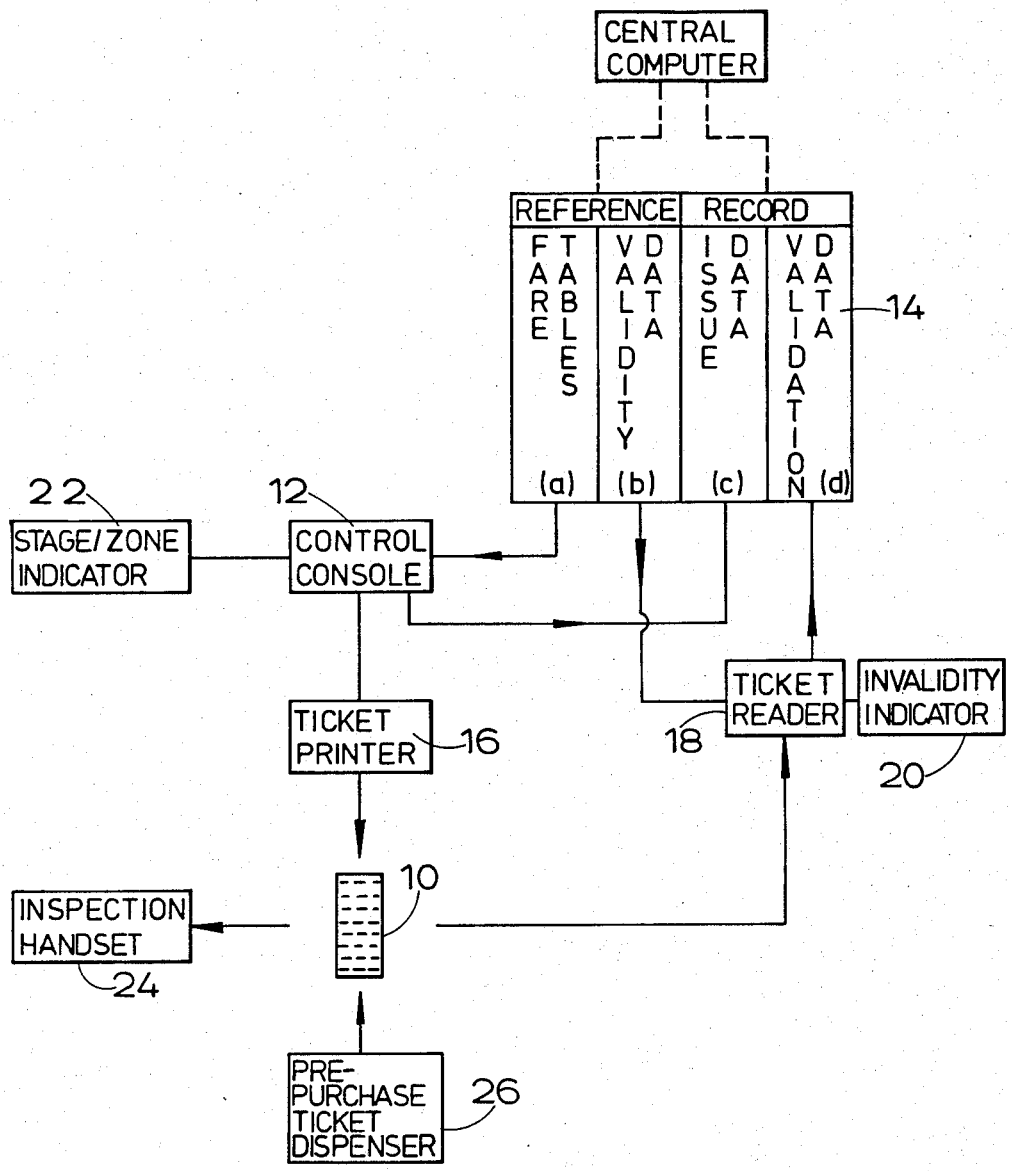
FIG. 1 illustrates in block diagram form the interrelationship between certain equipment employed, both on and off the bus.

In a through-ticketing system, each ticket 10 bears all the information necessary to define travel permissible with the ticket and to enable the validity of the ticket to be checked for travel on any particular vehicle at any particular time within the transport system. The information is printed on the ticket in an optically-machine-readable bar-code form. The information carried in bar-code form comprises a serial number and information characteristic of the nature and/or purpose of the ticket, such as information relating to the price paid for the ticket and/or the type of ticket (e.g. season, multi-journey, single, transfer) and/or the fare code (e.g. adult, child, return) and/or the expiry date and/or the state of origin and/or the stage of destination and/or zones within which the ticket can be validly used.

The bus, being one of a plurality of similarly equipped buses in the transport system, comprises a microprocessor-based unit providing a control console 12, for operation by the driver, and data-storing means 14 (referred to hereinafter as the memory). The memory 14 can, for convenience in description, be considered to comprise four portions 14*a* to 14*d*.

Ticket-issuing means on the bus comprises a ticket printer 16, associated with the control console 12, whereby bar-coded travel information can be printed on to a ticket (in a form readable by a ticket reader 18, referred to hereinafter) under instructions from the console. Each ticket may be taken from ticket stock bearing pre-printed serial numbers (which are also printed in bar-code), though for practical reasons it is preferred that the serial number be printed on by the ticket printer.

The ticket-issuing means has access to fare-table data stored in the memory 14*a*. Furthermore, the ticket-issuing means is arranged to communicate information born by and associated with each ticket issued (whether or not all of that information is printed on the ticket) to the memory 14*c*, whereby the information can be recorded for subsequent retrieval for management purposes. The printer is equipped to read bar-coded information, in order that the ticket serial number, and any other pre-printed information in bar-code, can be recorded.

For legal purposes, and for the convenience of passengers, the ticket printer 16 is arranged to print certain basic information on to each ticket also in an ordinary (non-coded) readable form.

The bus is equipped with ticket-checking means comprising a ticket reader 18 to which ticket-holding passengers can present their tickets on boarding the bus. The ticket reader is capable of optically reading information presented to it on a ticket in a printed bar-code form, and the checking means is capable of distinguishing between valid and invalid tickets, and capable of indicating that an invalid ticket has been presented. The ticket reader 18 is associated with the memory in order that it can compare information read from the ticket with reference information stored in the memory 14*b*. Upon so detecting an invalid ticket, for travel on that bus at that time, the ticket would be rejected and indicating means 20, comprising a buzzer to alert the driver, would be activated.

The ticket reader 18 is arranged to communicate information read from each ticket to the memory 14*d*, whereby the information can be recorded for subsequent retrieval for management purposes.

In order to provide an additional element of passenger information and to reduce the incidence of overriding, one or more large illuminated stage/zone indicators 22 are provided in the bus. The information so displayed corresponds with 'alighting stage' and 'valid zones' information printed on the tickets (where appropriate).

The indicators are arranged to be up-dated during travel by a fare-stage up-dating key of the control console 12, operated by the driver. Operation of the up-dating key serves also to up-date reference information in the memory 14 on which the ticket-issuing means and the ticket-checking means rely.

The bus is equipped also with portable ticket-inspecting means comprising an inspection handset 24 which is adapted to be carried within the bus and enables an inspector to check tickets for validity. The handset is adapted to read information presented to it on a ticket in bar-code, and is capable of displaying information read from the ticket in a form which can be read by the inspector. The handset is battery-powered and comprises optical bar-code reading means, a microprocessor with programmable memories, a keypad and an illuminated display. The memory of the handset can be programmed with sufficient travel information to enable it to check the validity of tickets presented.

Tickets for use in the transport system, especially such tickets as season tickets, can be pre-purchased from ticket dispensers 26 at convenient sites (e.g. railway stations, post offices, and bus depots).

As used in other applications, a conventional single bar-code digit comprises at least five, parallel, thick/-thin bars, spaced at uneven intervals. In order to provide a continuous stream of information, therefore, these digits are placed in an end-to-end format. In a through-ticketing situation, where as many as 128 digits may be required, we believe that each ticket would need to be in the region of 120–140 mm long.

In order to utilise the width of the ticket more efficiently, and thereby restrict the length to an acceptable size, the side-by-side bar-code format (as hereinbefore defined) is used.

The bar-code, in side-by-side format, may be based on the principle of hexadecimal binary notation, whereby each line comprises room for four 'bits' of information printed in the form of bars. This allows for the following number of digits to be encoded:

| | |
|---|---|
| one line/digit | 15 digits |
| two lines/digit | $15^2$ digits |
| three lines/digit | $15^3$ digits |

assuming that a clear line (i.e., no printed bars) would not constitute a digit.

In an effort to reduce errors which may be introduced by misreading of the bar code due to faint printing, smudging, defacing, creasing etc., some form of inherent checking should be incorporated into the code format.

Figure 2:
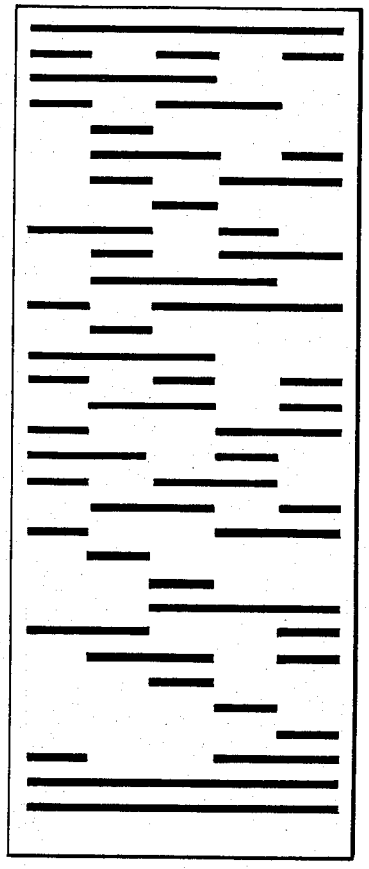
FIGS. 2 and 3 show two tickets which are printed in alternative side-by-side bar-code formats.

The bar-code information on a ticket can, in order to carry sufficient information, consist of 32 four-bit lines, giving a $4\times32$ matrix. Adding another column of bits to the ticket (making a $5\times32$ matrix) allows a parity check to be made on the original four-bit lines. The scheme works on the principle of a bar being added in the fifth column only if there is an even number of informational bars in that line. Such a ticket is shown in FIG. 2.

Should a single bar in any line be misread i.e., either an excessively faint bar, or a mark read as a bar, then this error will be detected by the parity bit check (even if it is the parity bit itself which is misread).

However, a preferred bar-code in side-by-side format is based on the three-out-of-five principle, even though this does not make such good use of space as the hexadecimal principle. In application of this principle, each line comprises room for five 'bits' of information printed in the form of bars. Since three bars are always printed in any one line this allows for the following number of digits to be encoded:

| | |
|---|---|
| one line/digit | 10 digits |
| two lines/digit | $10^2$ digits |
| three lines/digit | $10^3$ digits. |

Figure 3:
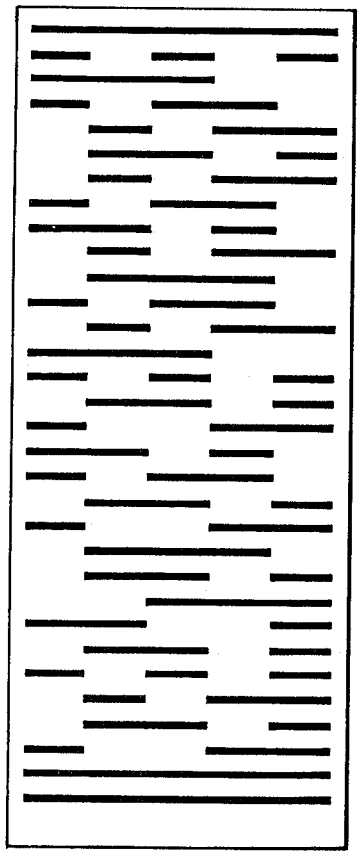

An advantage of employing the three-out-of-five principle is that it gives automatic parity checking (since there must always be three bars, and no more, in a line). Such a ticket is shown in FIG. 3.

For use on travel tickets which are to be read and, sometimes, printed on board a bus, the side-by-side format, and coding on either the three-out-of-five or hexadecimal principle, can give substantial advantages. Quite apart from the fact that, as already indicated, such an arrangement allows more effective use of ticket area, the use of only one kind of bar (rather than both thick and thin bars, as is conventional in end-to-end formats makes printing quality much less critical; instead of having to distinguish between thick and thin bars, a reading head has solely to be able to distinguish between the presence and the absence of a bar. Where both printing and reading equipment have to be operated fast, to print and read tickets on a moving vehicle, a certain ruggedness in the system is practically essential, and the proposed formats contribute significantly towards the achievement of that end.

In order to read tickets bearing information in bar-code in the side-by-side formats just described, the ticket reader 18 comprises five reading heads which are each arranged to scan one of the five columns of bits as the ticket is passed through the reader. The signals from the five reading heads are assessed, line by line, by the ticket-checking means in order to read the coded information on the ticket.

As the bus is equipped with its own bar-code printer 16, waybills can be printed in bar-code form, in addition to a conventionally printed summary. Relatively large amounts of information can thus be printed in an extremely compact form for automatic machine reading at the garage or depot. Audit time at the end of the driver's duty can be greatly reduced, and an inherent cross-checking facility is available, should it be required. Additionally, machine-readable waybills with a sufficiently low error rate greatly facilitate the entry of statistical data into central computing systems.

We claim:

1. A passenger-carrying vehicle equipped with ticket-checking means capable of reading information presented to it on a ticket in a printed bar-code form, capable of distinguishing between valid and invalid tickets, and capable of indicating that an invalid ticket has been presented.

2. A vehicle according to claim 1 in which said ticket-checking means is capable of assessing the validity of a ticket by reading information presented to it in a bar-code form on the ticket and comparing the read information with reference information to which it has access.

3. A vehicle according to claim 2 equipped with data-storing means whereby said reference information can be stored.

4. A vehicle according to any one of claims 1 to 3 in which said ticket-chekcing means is capable of communicating read information to a data store.

5. A vehicle according to claim 4 equipped with data-storing means whereby information read from tickets by said ticket-checking means can be recorded for subsequent retrieval.

6. A vehicle according to any one of claims 1 to 3 equipped also with ticket-issuing means arranged to issue tickets bearing information presented in a bar-code form readable by said ticket-checking means.

7. A vehicle according to claim 6 in which said ticket-issuing means is capable of printing on to a ticket in a bar-code form information which can be read by said ticket-checking means and which indicates travel permissible with the ticket issued.

8. A vehicle according to claim 6 in which said ticket-issuing means is capable eof communicating to a data store information born by tickets issued.

9. A vehicle according to claim 8 equipped with data-storing means whereby information communicated by said ticket-issuing means can be recorded for subsequent retrieval.

10. A vehicle according to claim 1 in which said ticket-checking means is arranged to read information presented in a side-by-side bar-code format (as hereinbefore defined).

11. A vehicle according to claim 10 in which said ticket-checking means is arranged to read information presented in a bar-code based on a three-out-of-five principle.

12. A vehicle according to any one of claims 1,2,3 or 10 in combination with portable ticket-inspecting means to be carried within the vehicle by an operator, said ticket-inspecting means being capable of reading information presented to it in a bar-code form on a ticket.

13. A vehicle according to claim 12 in which said portable ticket-inspecting means is capable of displaying information read from the ticket in a form which can be read by the operator.

* * * * *